US007506570B1

(12) United States Patent
Koski

(10) Patent No.: US 7,506,570 B1
(45) Date of Patent: Mar. 24, 2009

(54) MECHANISM TO HOLD AND RELEASE

(75) Inventor: Samuel R. Koski, Bowling Green, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/001,595

(22) Filed: Dec. 10, 2007

(51) Int. Cl.
*F41F 3/052* (2006.01)

(52) U.S. Cl. ..... 89/1.806; 114/238

(58) Field of Classification Search ..... 89/1.806, 89/1.807, 1.808, 1.809, 1.81; 114/238, 316, 114/318

See application file for complete search history.

(56) References Cited

U.S. PATENT DOCUMENTS

| | | | | | |
|---|---|---|---|---|---|
| 3,395,670 | A | * | 8/1968 | Betzold | 114/238 |
| 3,421,410 | A | * | 1/1969 | Kayaian | 89/1.807 |
| 3,481,246 | A | * | 12/1969 | Snyder | 89/1.51 |
| 4,012,988 | A | | 3/1977 | Knight | 89/1.806 |
| 4,016,796 | A | * | 4/1977 | Brannan | 89/1.806 |
| 4,416,183 | A | * | 11/1983 | Adams et al. | 89/1.807 |
| 4,550,640 | A | | 11/1985 | Harter | 89/1.806 |
| 4,917,526 | A | | 4/1990 | Paterson | 403/79 |
| 5,056,407 | A | * | 10/1991 | Mathey | 89/1.806 |
| 5,094,140 | A | | 3/1992 | Williams | 89/1.819 |
| 5,174,236 | A | * | 12/1992 | Moody | 114/238 |
| 5,291,820 | A | | 3/1994 | Hainsworth et al. | 89/1.819 |
| 5,398,588 | A | * | 3/1995 | Peck | 89/1.806 |
| 5,714,708 | A | | 2/1998 | Shim et al. | 89/1.806 |
| 5,918,307 | A | * | 6/1999 | Cipolla | 89/1.81 |
| 6,286,409 | B1 | | 9/2001 | Na et al. | 89/1.806 |

* cited by examiner

*Primary Examiner*—Bret Hayes
(74) *Attorney, Agent, or Firm*—Gerhard W. Thielman Esq

(57) ABSTRACT

A device is provided for holding and releasing a missile within a canister. The device includes a housing attached to the canister, a latch mechanism extending from the housing into the canister, a tension applier disposed in the housing to restrain the missile in the canister, a release mechanism disposed on the housing, an interface mechanism and a compression applier. The tension applier forces the latch mechanism against the housing to withdraw from the missile. The interface mechanism initially couples the release mechanism and the tension applier. The compression applier anchors to the interface mechanism and forces the latch mechanism against the housing to engage the missile and counteract said tension applier. On command, the release mechanism disengages from the housing to release the compression applier from the interface mechanism. This action enables the tension applier to withdraw the latch mechanism from the missile.

20 Claims, 6 Drawing Sheets

MECHANISM TO HOLD AND RELEASE

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to a hold-and-release mechanism. In particular, the mechanism maintains a thrust-generating missile within a deployment canister until release by command.

Select munitions can be launched from canister platforms, such as torpedoes and ship-launched missiles. Vertically launched missiles may be held in place by releasable clamps or shearable pins. A missile deployed within a launch tube and equipped with a solid rocket motor booster may be ejected from its canister by gas (e.g., steam) subsequently propelled by its booster. For launch from a submarine, the motor firing may be initiated after rising above the water's surface.

SUMMARY

Conventional mechanisms for restraining a canisterized missile yield disadvantages addressed by various exemplary embodiments of the present invention. These various exemplary embodiments provide a device for holding and releasing a missile within a canister. In particular, the device includes a housing attached to the canister, a latch mechanism extending from the housing into the canister, a tension applier disposed in the housing to restrain the missile in the canister, a release mechanism disposed on the housing, an interface mechanism and a compression applier.

The tension applier forces the latch mechanism against the housing to withdraw from the missile. The interface mechanism initially couples the release mechanism and the tension applier. The compression applier anchors to the interface mechanism and forces the latch mechanism against the housing to engage the missile and counteract said tension applier. On command, the release mechanism disengages from the housing to release the compression applier from the interface mechanism. This action enables the tension applier to withdraw the latch mechanism from the missile.

In various exemplary embodiments, the release mechanism is an electrically activated threaded explosive bolt. In alternate embodiments, the interface mechanism is a plate pivotably connected to the housing by a hinge. In various exemplary embodiments, the compression applier is an adjustable threaded compression bolt. Alternate embodiments provide for the housing to include a base that attaches to the canister, a chamber that contains the tension applier and a stub that attaches to the release mechanism. Various preferred embodiments provide for the release mechanism to include a sealing mechanism to inhibit leakage. The tension applier may be represented by a helical spring, and the latch mechanism may be represented by a push-rod.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

One submarine-based missile launch platform under consideration for operational depths is the Water Piercing Missile Launcher (WPML), which uses the rocket motor's exhaust to pierce the water. Upon production of an exhaust gas column that reaches the surface, the missile can be released to traverse the surface and continue towards its target. Various exemplary embodiments provide a hold and release mechanism (HRM) to restrain the missile during initial motor firing until conditions merit the missile to be released.

Figure 1:
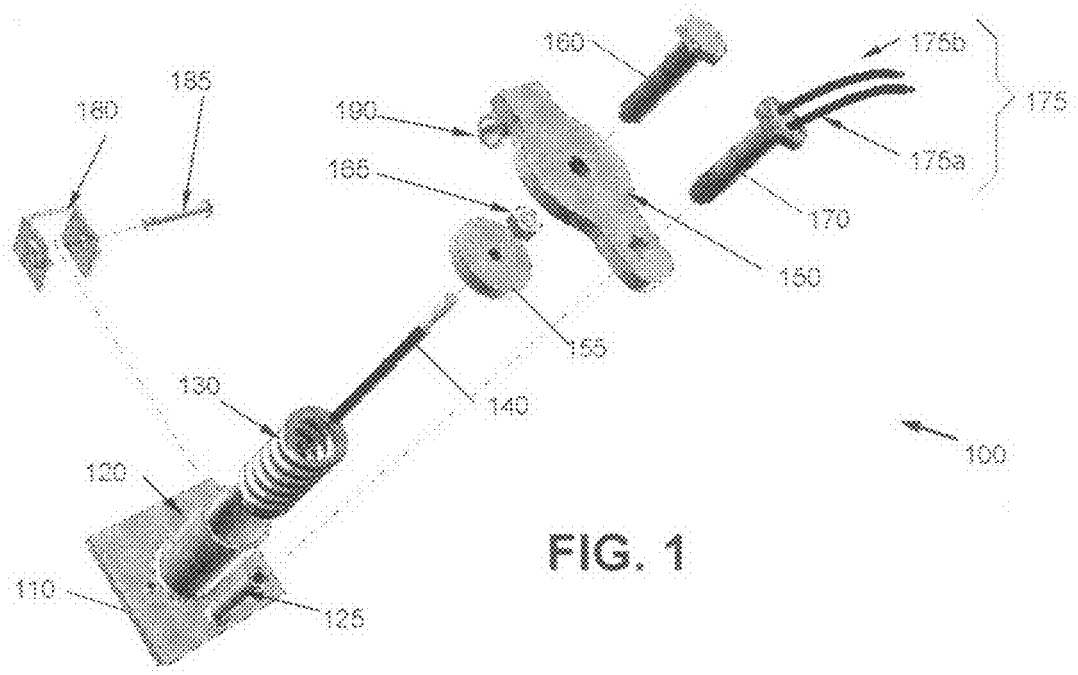
FIG. 1 is shows an exploded perspective view of components for a hold release mechanism.

FIG. 1 shows an exploded perspective view of components 100 for the HRM. A base plate 110 may be welded or bolted to a missile canister (to be subsequently described in more detail). Along the exposed surface of the plate 110 opposite the canister are disposed a pair of hollow cylinders: a larger-diameter barrel 120 and a smaller-diameter explosive tube 125. A helical release spring 130 may be disposed into the barrel 120 along their common longitudinal axes. A push-rod or pin 140 may be inserted within the release spring 130 along the common axis as installed. The barrel 120 and explosive tube 125 may be welded to the base plate 110 and together form the HRM housing.

A hinge plate 150 may be disposed over the hollow cylinders 120, 125, with a corresponding pair of through-holes aligned thereto. The hinge plate 150 may be characterized as having a substantially circular platform (having a center through-hole) and flanked by (nonsymmetrical) wing tabs (one of which includes a distal through-hole). An end plate or flat washer 155 having a center through-hole may be disposed between the hinge plate 150 and the open end of the barrel 120. A compression bolt 160 may be inserted through the center through-holes of the hinge plate 150 and the end plate 155. A threaded bolt 165 disposed between the plates 150, 155 may secure the bolt 160 in position to restrain the pin 140. The compression bolt 160 may have a predetermined length depending on design requirements.

An explosive bolt 170 may be disposed through the distal through-hole of the hinge plate 150 for insertion into the explosive tube 125. The explosive bolt 170 includes an energetic primer triggered to explode in response to electric current through circuit wires 175 that extend from the bolt's top. The distal wire 175*a* represents the hot wire typically colored red. The proximal wire 175*b* represents the neutral wire typically colored black. In the exemplary embodiments shown herein, the bolts 160, 170 are threaded for adjustably screwing in place.

A bracket 180 may be disposed adjacent to the open end of the barrel 120 opposite from the explosive tube 125. The bracket 180 may include a pair of axial through-holes yielding an axis substantially parallel to the base plate 110 and substantially perpendicular to a plane formed by the longitudinal axes of the cylinders 120, 125. A clevis pin 185 passes through the bracket's through-holes and a hinge sleeve 190 disposed on the hinge plate 150. The clevis pin 185 may be secured by a cotter pin. The barrel 120 and explosive tube 125 may be welded to the base plate 110 and together with the bracket 180 form the HRM housing.

Figure 2:
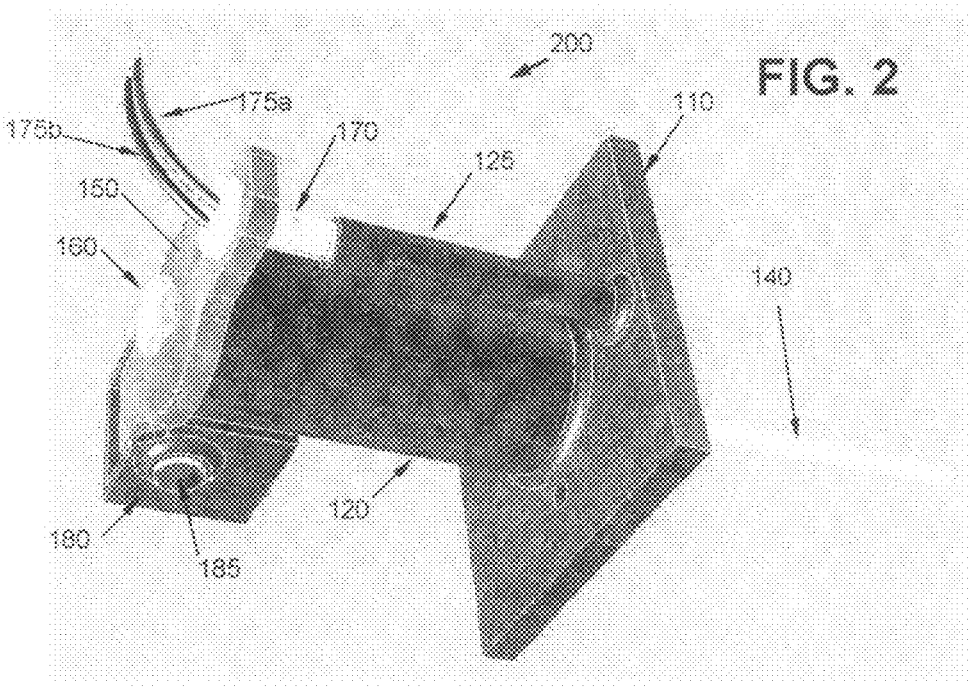
FIG. 2 is an assembly perspective view of the hold release mechanism.

FIG. 2 shows a perspective view of the HRM as an assembly 200. The push-rod 140 extends opposite the exposed surface of the base plate 110 (and into the canister). The barrel 120 and explosive tube 125 extend from the base plate 110. The hinge plate 150 with the bolts 160, 170 extending therethrough is disposed over the open end of the cylinders 120, 125, and the bracket 180 enables the hinge plate 150 to swing open upon commanded rupture of the explosive bolt 170.

Figure 3:
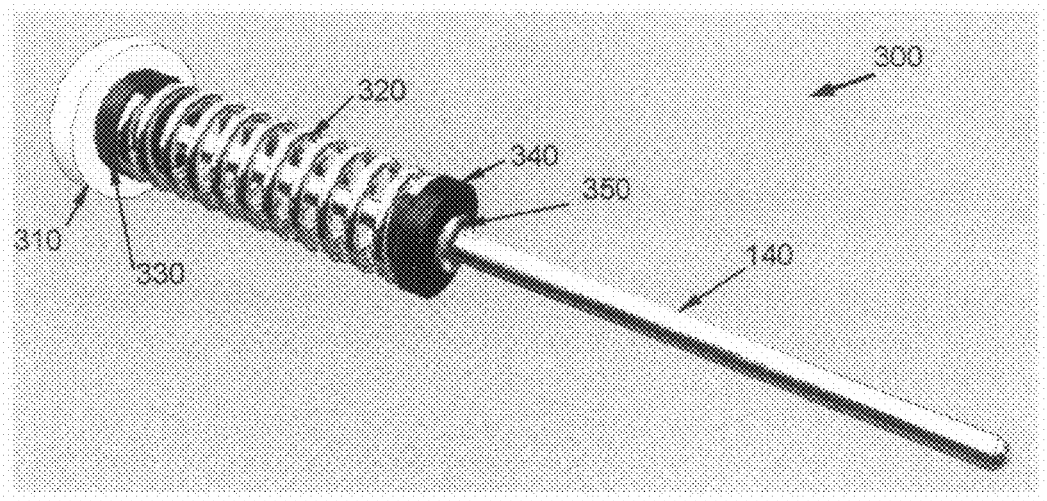
FIG. 3 is a perspective view of a push-rod assembly.

FIG. 3 shows a perspective view of a push-rod assembly 300 for sealing the barrel 120. The push-rod 140 may be secured to a stem 310 for connection to the base plate 110 and enveloped proximate to the stem 310 by a coil seal spring 320 terminated at each end by a pair of rubber tap washers 330 and 340. The proximal washer 330 may be disposed adjacent to the stem 310, while an o-ring 350 may form an annular seal around the push-rod 140. Upon assembly, the stem 310, spring 320, washers 330, 340 and o-ring 350 may be contained within the barrel 120, with the push-rod 140 protruding beyond the o-ring 350. This design inhibits leaking of liquid into the barrel 120, thereby enabling a water tight seal between the HRM and the WPML.

Figure 4:
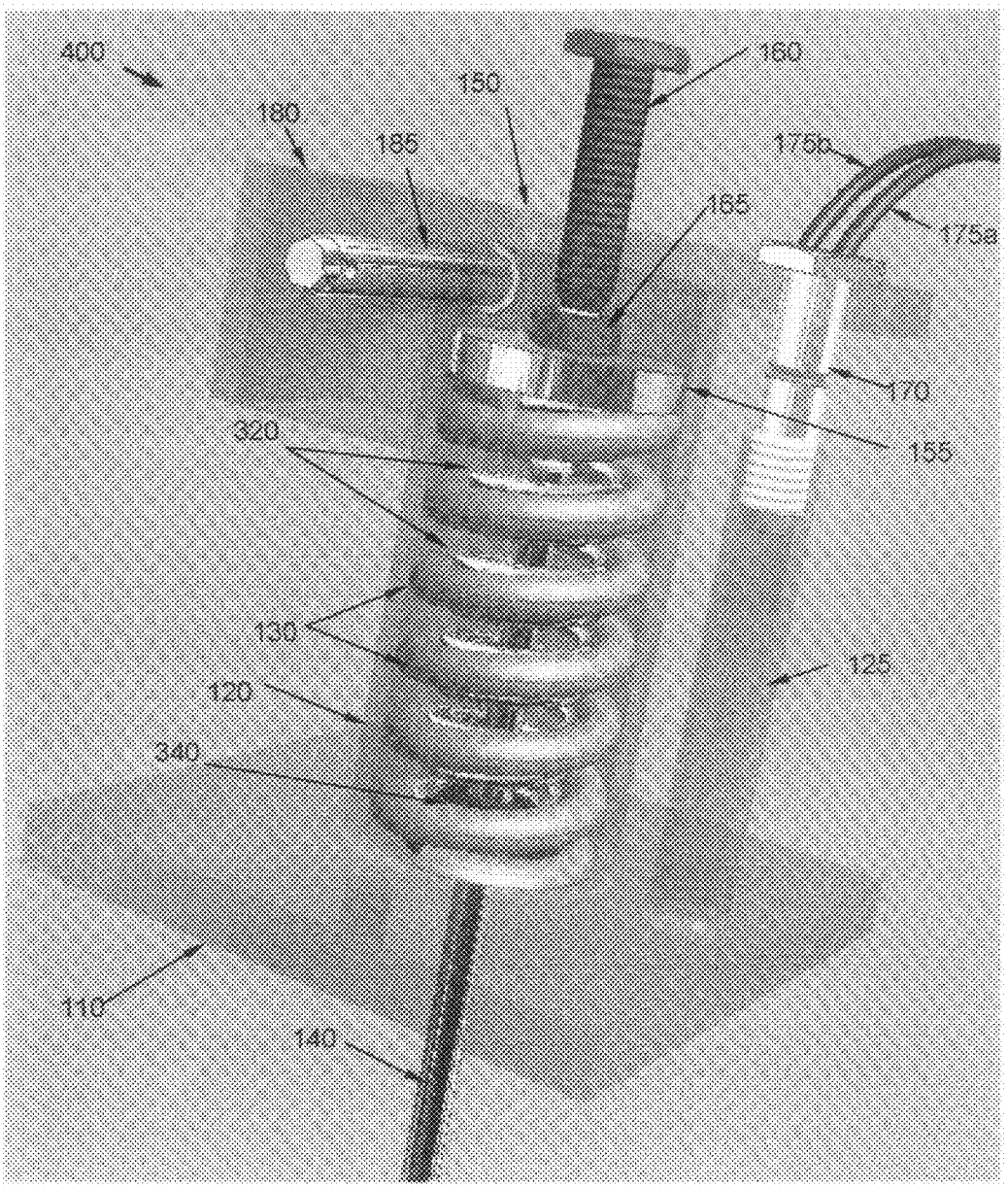
FIG. 4 is a see-through perspective view of the hold release mechanism.

FIG. 4 shows a partially see-through perspective view of the HRM assembly 400, featuring internal components from FIGS. 1 and 3 as installed and assembled in FIG. 2. This configuration illustrates the compression bolt 160 prior to being fully screwed in the hinge plate 150 to squeeze the release spring 130, with the seal spring 320 and distal washer 340 nestled within and around the push-rod 140. The explosive bolt 170 visibly shows the scored region for separation, with its distal portion (inserted into the tube 125 and opposite the wires 175) containing the primer for command release via electric current.

The HRM represents as a cost effective mechanism to restrain a missile for a predetermined time before enabling its exit from the launcher. The mechanism assembly 200 engages the push-rod 140 through the canister (along its cylindrical wall) and into the missile. Four of these mechanisms may be disposed in a cruciform pattern, for example, to ensure force balance along the missile's longitudinal centerline. Upon firing the missile's rocket motor, the push-rod 140 restrains the missile from flying out until a column of exhaust gas punches a hole through the water. Once this column has formed, all push-rods 140 are pulled for each of the assemblies 200 pulled, thereby enabling the missile to fly through the column unabated.

Scale tests were conducted in which the push-rods 140 were pulled with explosive pin pullers. Such a puller includes a piston disposed over an explosive charge and attached to a heavy pin. Upon initiating the charge, the rapidly expanding gasses move the piston, thereby pulling the push-rod 140 to release the missile. Typically, these must explosively tailored to the application, are single-use only and can be quite expensive. The HRM may serve as a pin puller for missile launch applications with advantages of design flexibility and repeatable operations with substantially the same equipment, except for the explosive bolt 170 that is consumed at launch.

Assembly instructions for the HRM based on the views in FIGS. 1-3 are listed as follows:

(1) Attach the hinge plate 150 to the barrel 120 of the HRM housing by inserting the clevis pin 185 secured with a cotter pin. The hinge plate 150 preferably rotates freely about the clevis pin 185, disposed at rest preferably flush with the barrel's open end.

(2) Install the release spring 130 in the barrel 120.

(3) Assemble the push-rod 140 within its assembly 300. This includes the operations:

(a) Thread the push-rod 140 into stem 310 and secure with a nut.

(b) Install the proximal washer 330 under the stem 310.

(c) Install the seal spring 320.

(d) Install the distal washer 340 over the seal spring 320.

(e) Install the o-ring 350 under the distal washer 340.

(4) Install push-rod assembly 300 into the barrel 120, such that the push-rod 140 protrudes beyond the base plate 110.

(5) Install a grade-8 bolt in place of the explosive blot 170 and tighten, but not excessively. A torque of 50 inch-pounds may be used as an example reference.

(6) Install 1¼ inch grade-8 compression bolt 160 with the end plate 165.

(7) Tighten the bolt 160 until being in contact with hinge plate 150 then torque to 150 inch-pounds.

(8) Measure length of the push-rod 140 extending from the base plate 110. Slight adjustments may be made by threading the push-rod 140 farther into stem 310.

After the hinge plate 150 contacts the barrel 120 and the explosive bolt 170 is disposed in place and tightened, the compression bolt 160 can be tightened down and torqued. When tightened, the compression bolt 160 presses against the push-rod 140 threaded into the stem 310 to push against and restrain the missile in the canister. The end plate 155 (connected to the hinge plate 150) uniformly presses against the distal end of the release spring 130 to compress it. Upon initiating the explosive bolt 170, the hinge plate 150 rotates about the clevis pin 185 releasing the push-rod 140 to be pushed out by the force of the release spring 130.

Figure 5:
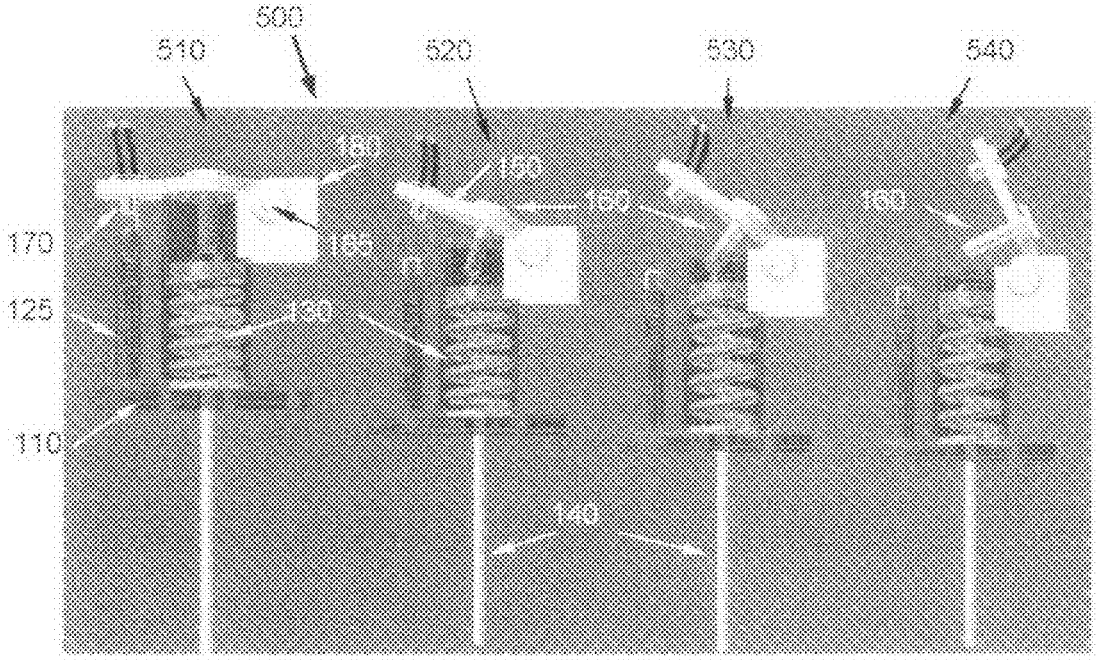
FIG. 5 is an elevation view of the hold release mechanism in operation.

FIG. 5 shows an example of the HRM operation 500 during initiation of the explosive bolt 170. The position sequences are shown in four (4) stages: loaded 510, activated 520, travel 530 and release 540. In the loaded position 510, the explosive bolt 170 is fastened in place and the central bolt 160 is fully engaged, thereby compressing the release spring 130.

Upon initiation of the explosive bolt 170 in the activated position 520, the tensile force by the release spring 130 against the compression bolt 160 causes the hinge plate 150 to rotate about the clevis pin 185 in an involute curve trajectory, which continues into the travel position 530. The compression bolt 160 can be screwed a substantial distance into the barrel 120 to fully deflect the release spring 130, and nonetheless withdraw in the release position 540 without contacting the interior side of the barrel 120 upon ejection. As the compression bolt 160 rotates in the release position 540, the release spring 130 extends within the barrel 120 towards its open end, thereby withdrawing the push-rod 140 (at least partially) from the canister to release the missile.

Figure 6:
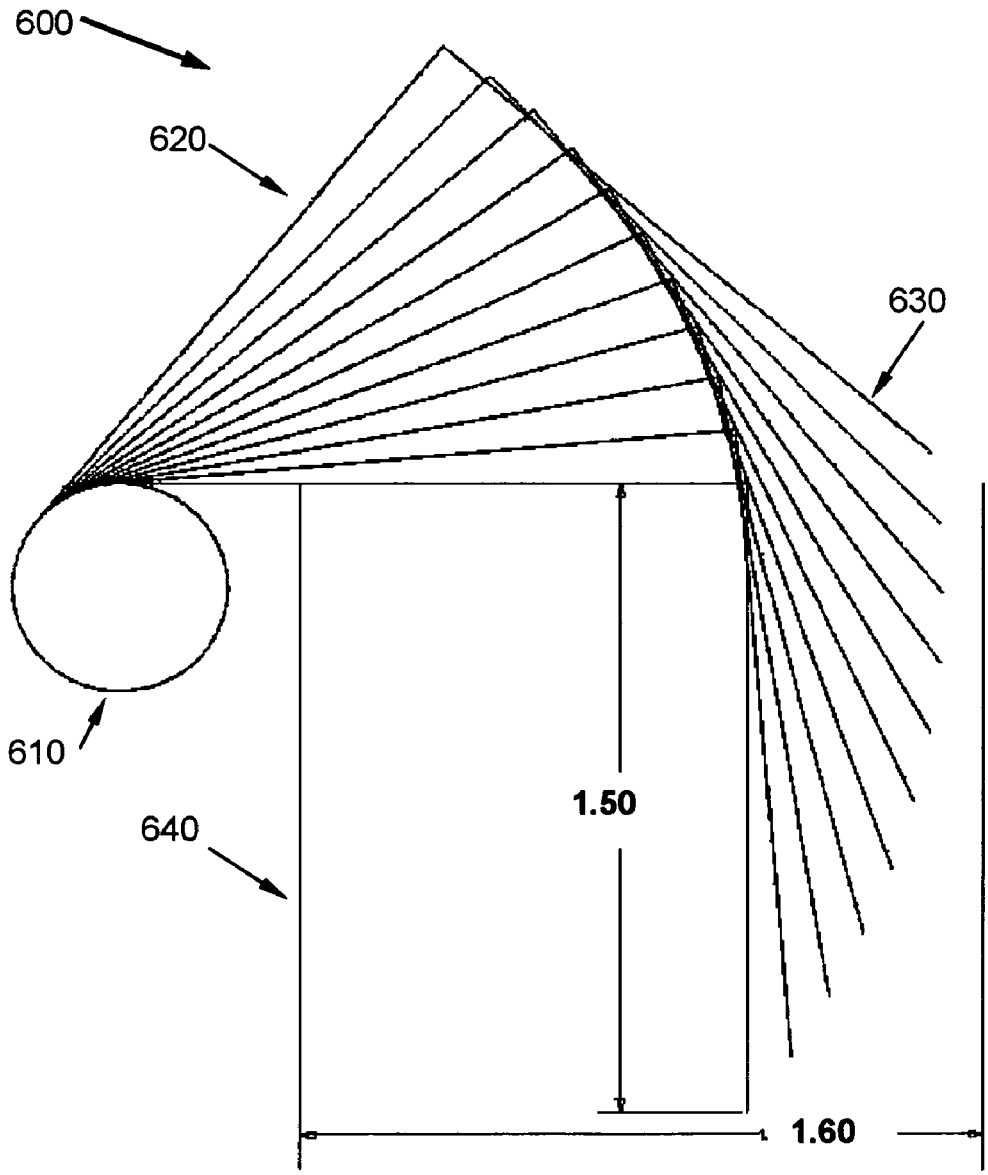
FIG. 6 is an elevation view of time-elapsed travel positions for components of the hold release mechanism.

FIG. 6 shows an elevation view of travel trajectory positions 600 of select components for a 0.50 inch diameter compression bolt 160. The hinge plate 150 follows an offset rotation path 610 around the clevis pin 185. The plate's inner surface (initially facing the open end of the barrel 120 in the loaded position 510) is depicted along the rotation path 610 as a series of swinging path plate positions 620. The hinge plate 150 is pushed by the release spring 130 in response to retreat by the compression bolt 160 along a swinging bolt path 630 within an inner cylindrical diameter 640 of the barrel 120.

Dimensions as shown in FIG. 6 indicate an exemplary embodiment for recently conducted tests. In this example, the barrel 120 has an internal cylindrical diameter of 1.60 inches, and the compression bolt 160 extends 1.50 inches into the barrel 120 (which may be 3.50 inches in length).

Figure 7:
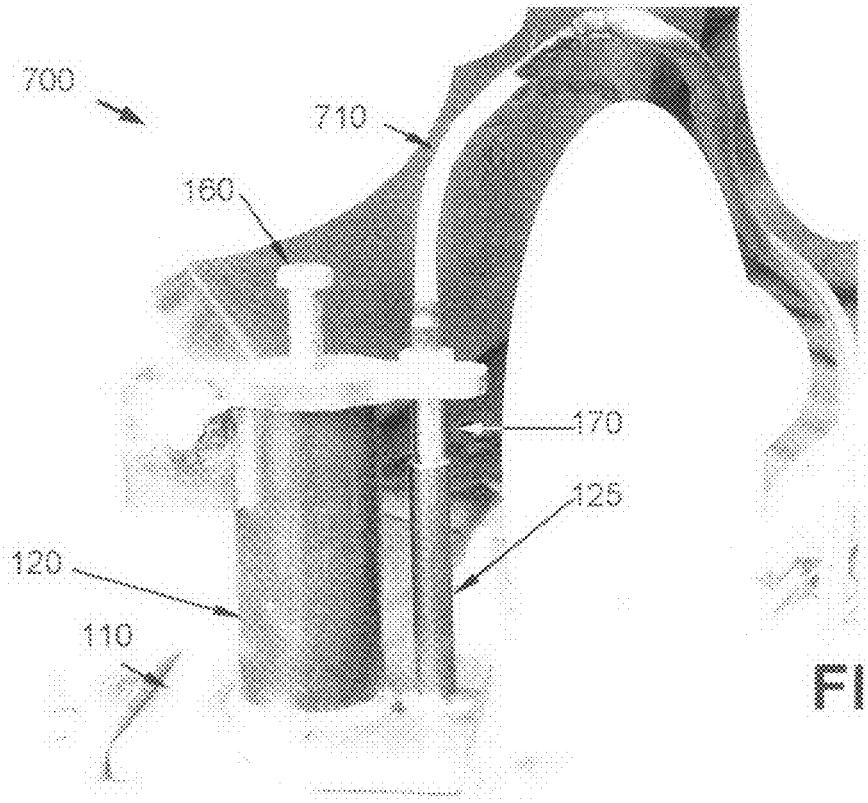
FIG. 7 is a perspective side view of the hold release mechanism as installed on a canister.
Figure 8:
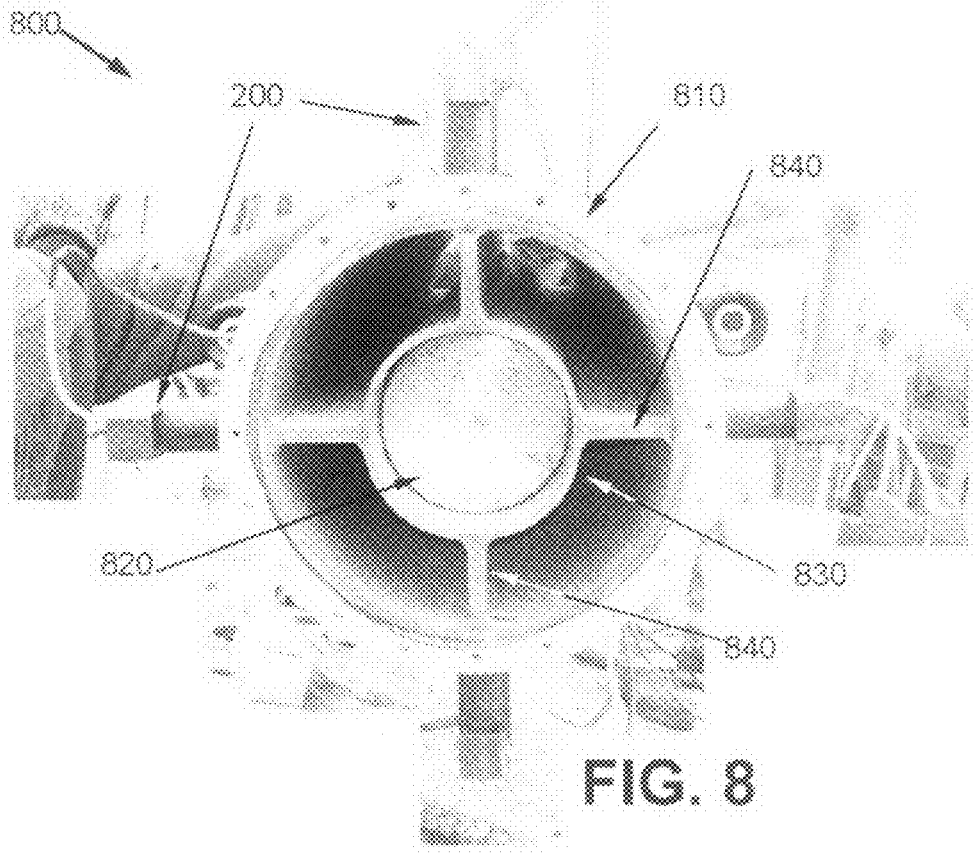
FIG. 8 is a perspective aft view of the canister with four hold release mechanisms installed.

FIG. 7 shows an installed configuration 700 in perspective view from the side with the base plate 110 of the HRM assembly 200 disposed on a canister. The compression bolt 160 is shown prior to being screwed into the barrel 120. The wires 175 (attached to the explosive bolt 170 in the tube 125) are wrapped within an insulation cable 710. The FIG. 8 shows an installed configuration 800 in perspective from the rear with each HRM assembly 200 securely attached to an outer annulus (attach ring) 810 of the canister that contains a simulated missile 820 within an inner annulus 830. A cruciform set of plates 840 secures the inner annulus 830 to the outer annulus 810. The push-rods 140 from the HRM assemblies 200 pass through the plates 840 to restrain the (simulated) missile 820.

Figure 9:
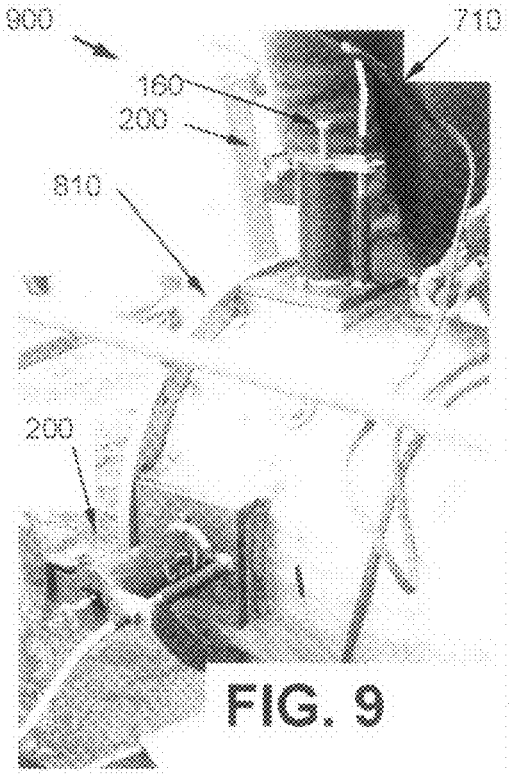
FIG. 9 is a perspective side view of the canister prior to launch initiation.
Figure 10:
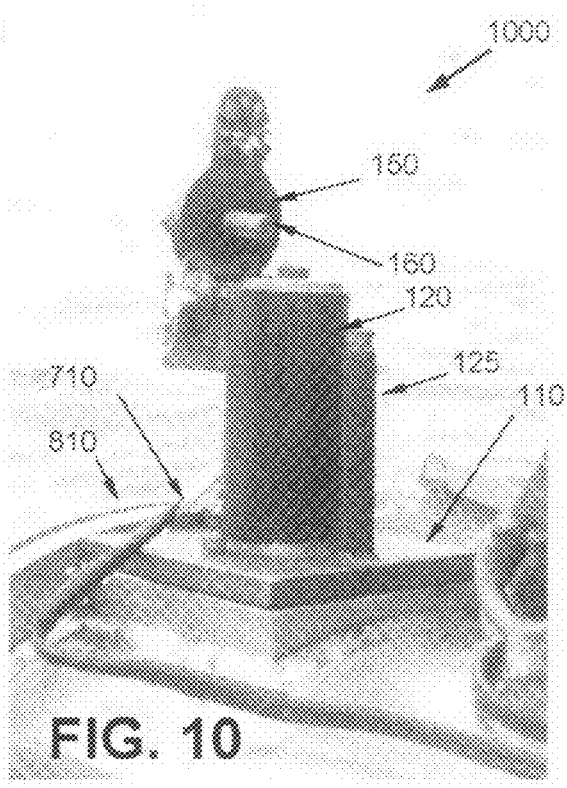
FIG. 10 is a perspective side view of the release mechanism subsequent to launch initiation.

FIG. 9 shows another perspective view 900 of the canister's outer annulus 810 and the attached HRM assemblies 200 from the side (prior to the compression bolt 160 being tightened). FIG. 10 shows a perspective view 1000 of the HRM assembly 200 after initiation, in which the compression plate 160 has been hinged away from the barrel's opening after the explosive bolt's discharge.

Figure 11:
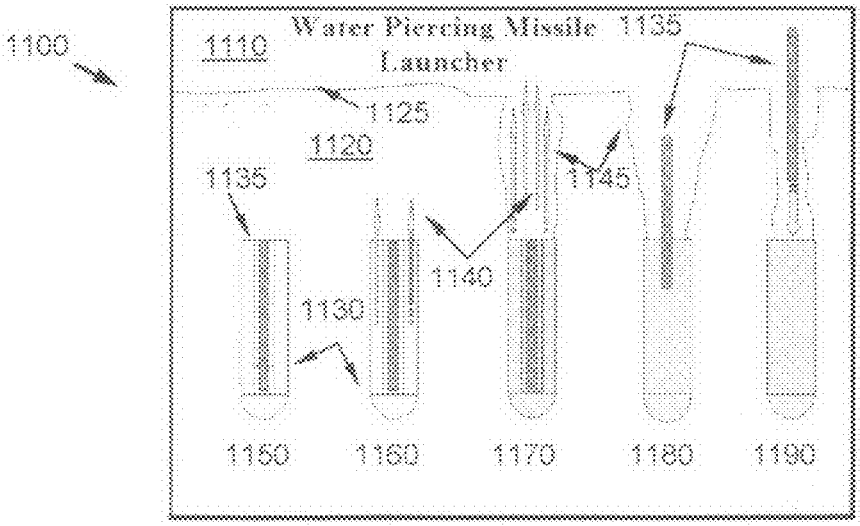
FIG. 11 is an elevation diagram of time-elapsed missile positions in the canister.

FIG. 11 shows an elevation view 1100 of launching stages for the WPML into the atmosphere 1110 from deployment under water 1120 between the water's surface 1125 and the submarine-deployed canister 1130. The missile 1135 can be ejected by firing its motor to produce exhaust gas 1140 thereby producing a gas column 1145 thereby piercing the water 1120 to its surface 1125. The stages include pre-launch 1150, motor firing 1160, column production 1170, missile release 1180 and missile fly-out 1190 beyond the surface 1125. The HRM assemblies 200 restrain the missile 1135 until the gas column 1145 reaches the surface 1125 (and the motor's thrust is sufficient to propel the missile 1135) out of the canister 1130.

The HRM was tested successfully in design mode at least sixteen times. The final test (to date) in September 2007 incorporating four (4) HRM units produced a successful missile fly-out and proof-of-concept for the WPML. Further tests are expected as the WPML program evolves.

In general, the time from initiation of the rocket motor to the time when the HRM is activated, varies with application and rocket motor type. For the September 2007 successful WPML missile fly-out test, experimental data indicated that the missile 1135 should be held within the canister 1130 for approximately one second to form a stable column 1145. At this time, the explosive bolt 170 was initiated through a time-delay switch, enabling the push-rod 140 to release the missile 1135.

The HRM assembly 200 is flexible in design, such that stronger or weaker springs 130, 320 may be used. The HRM assembly 200 can be made dimensionally smaller or larger depending on the application. For example, an upcoming WPML program may employ a Tomahawk rocket motor, which has substantially greater thrust than the Jato rocket motor used in the September 2007 test. Artisans of ordinary skill will recognize that substituting springs of different strength and/or scaling particular dimensions may augment the HRM design for specific applications without departing from the inventive concept.

In principle, the HRM assembly 200 can be described as including a housing, a pivotable interface, a latching mechanism, a tension applier, an adjustable compression applier and a release mechanism. The housing may include the base plate 110 with the barrel 120 (e.g., chamber for the latching mechanism and tension applier) and the tube 125 (e.g., stub for the release mechanism).

In the configuration shown, the barrel 120 and tube 125 may be connected (e.g., by welding) on the base plate's outer surface. Similarly, the plate's lower surface may connected to the canister 1130 (by welding), and the bracket 180 may be attached near the open end of the barrel 120. The pivotable (i.e., swingable on a pivot) interface may be represented by the hinge plate 150 coupled with the end plate 155 and the nut 165. The interface may be hinged, for example, on the sleeve 190 to the clevis pin 185. This interface couples the tube 125 with the barrel 120 to be secured and released concurrently.

The latching mechanism (or latch) may be represented by the push-rod 140 that restrains the missile 1135 in the canister 1130. The adjustable compression applier may be represented by the compression bolt 160 to dispose the latch against the missile 1135. The release mechanism may be represented by the explosive bolt 170 that initially secures the interface to the housing for its subsequent withdrawal on command. The tension applier may be presented by the release spring 130 to drive the latch away from the missile 1135 for its launch from the canister 1130 upon activation of the release mechanism.

The HRM includes various advantages, such as being inexpensive as compared with the alternate explosive pin pullers. The HRM can be manufactured from off-the-shelf materials, and explosive bolts 170 are readily available and easily manufactured items. The HRM is reusable, with the exception of the explosive bolts. The HRM can be scaled in size and strength to function in different configurations and to overcome different load requirements.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A device for holding and releasing a missile within a canister, the device comprising:

a housing that is attachable to the canister;

a latch mechanism that extends from said housing into the canister to engage the missile for restraining the missile in the canister;

a tension applier that forces said latch mechanism against said housing to withdraw from the missile;

a release mechanism disposed on said housing;

an interface mechanism that initially couples said release mechanism and said tension applier; and a compression applier that anchors to said interface mechanism and forces said latch mechanism against said housing to engage the missile and counteract said tension applier, wherein said release mechanism disengages from said housing on command to release said compression applier from said interface mechanism that enables said tension applier to withdraw said latch mechanism from the missile.

2. The device according to claim 1, wherein said release mechanism is an electrically activated threaded explosive bolt.

3. The device according to claim 1, wherein said interface mechanism is a plate pivotably connected to said housing by a hinge.

4. The device according to claim 1, wherein said compression applier is a threaded compression bolt able to adjust penetration depth into said housing.

5. The device according to claim 1, wherein said housing includes a base that attaches to the canister, a chamber that contains said tension applier and a stub that attaches to said release mechanism.

6. The device according to claim 5, wherein said tension applier further includes a sealing mechanism to inhibit water from leaking into said chamber.

7. The device according to claim 5, wherein said tension applier is a helical spring that pushes said interface mechanism against said base.

8. The device according to claim 1, wherein said latch mechanism is a push-rod that mechanically engages the missile.

9. A missile canister system for launching a missile, comprising:

a canister containing the missile;

a housing that is attachable to said canister;

a latch mechanism that extends from said housing into said canister to engage the missile for restraining the missile in said canister;

a tension applier that forces said latch mechanism against said housing to withdraw from the missile;

a release mechanism disposed on said housing;

an interface mechanism that initially couples said release mechanism and said tension applier; and a compression applier that anchors to said interface mechanism and forces said latch mechanism against said housing to engage the missile and counteract said tension applier, wherein said release mechanism disengages from said housing on command to release said compression applier from said interface mechanism that enables said tension applier to withdraw said latch mechanism from the missile.

10. The system according to claim 9, wherein said release mechanism is an electrically activated threaded explosive bolt.

11. The system according to claim 9, wherein said interface mechanism is a plate pivotably connected to said housing by a hinge.

12. The system according to claim 9, wherein said compression applier is a threaded compression bolt.

13. The system according to claim 9, wherein said housing includes a base that attaches to said canister, a chamber that contains said tension applier and a stub that attaches to said release mechanism.

14. The system according to claim 9, wherein said latch mechanism is a push-rod that mechanically engages the missile.

15. A method for holding and releasing a missile within a canister, the method comprising:

attaching a housing to the canister;

extending a latch mechanism from said housing into the canister to engage the missile for restraining the missile in the canister;

applying tensile force by a tension applier to said latch mechanism against said housing for withdrawing said latch mechanism from the missile;

disposing a release mechanism on said housing;

initially coupling said release mechanism and said tension applier by an interface mechanism;

anchoring a compression applier to apply force to said interface mechanism against said housing to engage the missile and counteract said tension applier; and disengaging said release mechanism from said housing on command to release said compression applier from said interface mechanism that enables said tension applier to withdraw said latch mechanism from the missile.

16. The method according to claim 15, wherein attaching said housing further includes:

providing a base that attaches to the canister;

attaching to said base a chamber that contains said tension applier; and attaching to said base a stub for disposing said release mechanism.

17. The method according to claim 16, wherein disengaging said release mechanism further includes pivoting said interface mechanism to open out from said chamber.

18. The method according to claim 16, wherein anchoring said compression applier further includes adjustably inserting said compression applier through said interface mechanism into said chamber to contact said tension applier in compression.

19. The method according to claim 16, wherein disposing said release mechanism further includes threading a bolt containing an electrically activated explosive charge into said stub.

20. The method according to claim 19, wherein disengaging said release mechanism further includes applying an electric current to said explosive charge to disconnect said release mechanism from said stub.

* * * * *